US009079186B2

(12) United States Patent
Könning et al.

(10) Patent No.: US 9,079,186 B2
(45) Date of Patent: Jul. 14, 2015

(54) ROLLER MILL AND METHOD FOR DRIVING A ROLLER MILL

(75) Inventors: Ludwig Könning, Ahlen (DE); Guido Scholz, Münster (DE); Benjamin Berndzen, Münster (DE)

(73) Assignee: ThyssenKrupp Industrial Solutions AG (DE)

( * ) Notice: Subject to any disclaimer, the term of this patent is extended or adjusted under 35 U.S.C. 154(b) by 598 days.

(21) Appl. No.: 13/516,372

(22) PCT Filed: Jan. 18, 2011

(86) PCT No.: PCT/EP2011/050613

§ 371 (c)(1),
(2), (4) Date: Jun. 15, 2012

(87) PCT Pub. No.: WO2011/113624

PCT Pub. Date: Sep. 22, 2011

(65) Prior Publication Data

US 2012/0259451 A1 Oct. 11, 2012

(30) Foreign Application Priority Data

Mar. 18, 2010 (DE) ..... 10 2010 016 011

(51) Int. Cl.
*B02C 15/00* (2006.01)
*B02C 25/00* (2006.01)

(52) U.S. Cl.
CPC ..... *B02C 15/006* (2013.01); *B02C 15/007* (2013.01); *B02C 25/00* (2013.01); *B02C 2015/008* (2013.01)

(58) Field of Classification Search
CPC .. B02C 25/00; B02C 15/007; B02C 2015/008
USPC ..... 241/30, 36, 117–121
See application file for complete search history.

(56) References Cited

U.S. PATENT DOCUMENTS 8,262,006 B2 * 9/2012 Berger et al. ..... 241/119

FOREIGN PATENT DOCUMENTS

| | | | |
|---|---|---|---|
| DE | 3602932 | A1 | 8/1987 |
| DE | 19702854 | A1 | 7/1998 |
| JP | 05049960 | | 3/1993 |
| WO | 2006108852 | A1 | 10/2006 |

* cited by examiner

*Primary Examiner* — Faye Francis
(74) *Attorney, Agent, or Firm* — Renner Kenner Greive Bobak Taylor & Weber

(57) ABSTRACT

A roller mill includes a grinding table, at least one grinding roller in rolling engagement with the grinding table, a main drive system for driving the grinding roller and/or the grinding table, and an auxiliary drive for driving the grinding table. The auxiliary drive includes at least two linear drives for rotating the grinding table and a control device for individually controlling the linear drives in order to provide an uninterrupted rotational movement.

10 Claims, 4 Drawing Sheets

ROLLER MILL AND METHOD FOR DRIVING A ROLLER MILL

The invention relates to a roller mill having a grinding table, at least one grinding roller which is in rolling engagement with the grinding table, a main drive system for driving the grinding roller and/or the grinding table and an auxiliary drive for driving the grinding table. The invention further relates to a method for driving such a roller mill.

With vertical roller mills, a large central gear mechanism which is driven by means of a main drive or an auxiliary drive is generally located below the grinding table. When the mill is started up, the auxiliary drive, as a support for the main drive, ensures a high level of torque on the grinding table. Furthermore, it is capable of clearing a mill which has become filled after an emergency stop and thus enabling a new mill start. Furthermore, it ensures slow rotation of the grinding table during assembly and maintenance operations in the mill.

If the drive concept of the roller mill is changed and the grinding table is driven only via the grinding rollers and the drives thereof, as described, for example, in DE 197 02 854 A1, the central main drive below the grinding table can be dispensed with. Instead there is purely support of the grinding table without any drive function. If no separate auxiliary drive is provided for the grinding table, the grinding table can be rotated only by means of the friction contact of the driven rollers with respect to the grinding path or the grinding stock. In particular when grinding non-coarse-grained materials or when the mill of the "clean swept" empty mill is started, consequently, the driven grinding rollers may not engage. The grinding table can thereby not be rotated and the grinding process is not started. There is therefore provided in DE 197 02 854 A1 an additional auxiliary drive for the grinding table, which provides assistance for this and which brings about a clear increase in the operational reliability of the mill.

In this instance, the auxiliary drive is connected to a large internal geared wheel on the grinding table by means of a pinion gear.

DE 36 02 932 A1 offers another approach in which the grinding table is rotated in addition to the grinding rollers by a direct drive.

In both solutions, the costs for the auxiliary drive or the direct drive are far too high in relation to the benefit, when they are intended to produce a high level of torque on the grinding table.

JP 05 049 960 A further discloses a vertical mill with a dam ring which can be adjusted by means of a linear drive. A synchronous linear motor is further described in DE 10 2005 017 501 A1.

An object of the invention is therefore to provide a roller mill having a cost-effective auxiliary drive for the grinding table and a method for operating a roller mill so that a reliable mill start and simple maintenance of the mill are enabled.

According to the invention, this object is achieved by the features of claims 1 and 7.

The roller mill according to the invention substantially comprises a grinding table, at least one grinding roller which is in rolling engagement with the grinding table, a main drive system for driving the grinding roller and/or the grinding table and an auxiliary drive for driving the grinding table. The auxiliary drive comprises at least two linear drives for rotating the grinding table and a control device for individually controlling the linear drives in order to provide an uninterrupted, that is to say, continuous rotational movement.

With the concept of a roller mill, in particular a vertical roller mill, in which only the grinding rollers are driven during grinding operation, there is no possibility of rotating the grinding table independently of the roller drives without the auxiliary drive. This fact has a detrimental effect, particularly when the friction between the grinding roller, grinding stock and grinding table is not sufficient to transmit adequate force from the grinding rollers to the grinding table. The consequence is potential overrunning of the grinding rollers with the result that the roller mills cannot be started. In particular with the use of a zero gap stop which is conventional nowadays and in which a minimum air gap is determined between the grinding roller and grinding table for technical reasons relating to the protection of the machine, there is the risk that insufficient material can be drawn into the grinding gap when the mill is started. It is therefore desirable to install a drive system for the grinding table that is independent of the grinding roller drives. The auxiliary drive for the grinding table can reliably ensure during the starting operation that sufficient material which is located in front of the grinding rollers is directed towards them so that the grinding rollers securely engage in the grinding stock and they can consequently transmit their drive power. In particular when starting the roller mill after an emergency stop, a high torque must be applied to the grinding table in order to release the material on the grinding table and the discharge ring. The torque required for this may be from 1.75 to 2.4 times greater than the design torque at the mill shaft.

With the linear drives provided according to the invention, this object can be readily achieved in a cost-effective manner. In addition to supporting the starting operation, however, the auxiliary drive can also be used during maintenance and assembly operations. It is thereby possible with the linear drive to gradually rotate and position the grinding table for assembly operations.

The dependent claims relate to other configurations of the invention.

The high starting torque required for roller mills is reflected with the known gear-based drive concepts in high costs for the individual components. In particular the powerful motors required and a large toothed ring which is configured for high torque are decisive in this instance. According to the invention, the linear drives are connected to the grinding table by means of at least one coupling gear, which is preferably formed by a ratchet wheel which is secured to the grinding table. The linear drives can additionally be formed in a particularly cost-effective manner by means of hydraulic cylinders which, at a relatively low price, at the same time provide a high power density. In connection with a hydraulic power supply and a corresponding control unit, they can be used to rotate the grinding table by means of a ratchet wheel which is mounted on the grinding table base and which is constructed as a coupling gear. Owing to intelligent logical connection or control of the linear drives by the control device, the alternating retraction and extension of the linear drives can be converted into an uninterrupted rotational movement.

To this end, the linear drives are advantageously arranged at an angle of +/−10° with respect to the grinding table tangent. With a correspondingly large reference diameter of the ratchet wheel, the provision of high drive torques is ensured in this manner.

According to another embodiment of the invention, the linear drives can be adjusted between a drive position and a non-drive position, the linear drives in the drive position being in operational contact with the grinding table, in particular with the ratchet wheel which is secured thereto, in order to rotate it, whilst the contact with the grinding table is cancelled in the non-drive position. The grinding process is not disrupted and the auxiliary drive is not subjected to any wear during this time. Furthermore, the transition from the auxiliary drive to the main drive of the roller mill can be carried out continuously and without an abrupt speed transition.

Using at least two linear drives, a linear movement of the linear drives can be converted into a rotational movement of the grinding table. It is advantageous for the forward and backward travel of the linear drives to be carried out at different times. For example, it is thus possible for at least one linear drive to be retracted from its outermost end position, whilst at least one other linear drive still carries out its operating travel. Uninterrupted rotational movement is thereby possible.

Of course, the control device can control the linear drives as necessary, in particular during assembly and maintenance operations, in such a manner that the grinding table is stopped at specific positions.

According to another embodiment of the invention, the travel speed of the linear drives can be adjusted in a variable manner in order to produce different speeds of the grinding table. With such control of the grinding table, this can also be used, for example, to weld a wear protection member to the grinding path.

Other advantages and embodiments of the invention will be explained in greater detail below with reference to the description and the drawings, in which.

Figure 1:
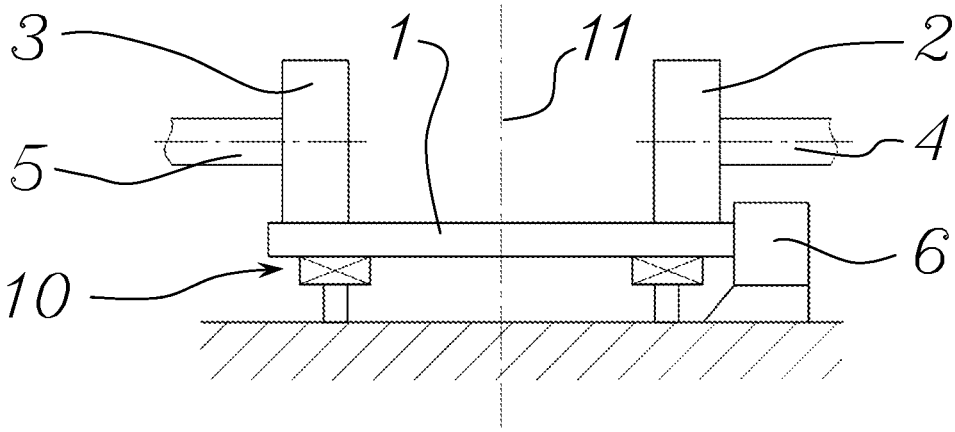
FIG. 1 is a schematic side view of a roller mill.

The roller mill illustrated in FIG. 1 substantially comprises a grinding table 1, at least one grinding roller 2, 3 which is in rolling engagement with the grinding table, a main drive system 4, 5 for driving the grinding rollers and an auxiliary drive 6 for driving the grinding table 1. Of course, it is also possible to provide more than two grinding rollers, in particular three or four grinding rollers.

Figure 2:
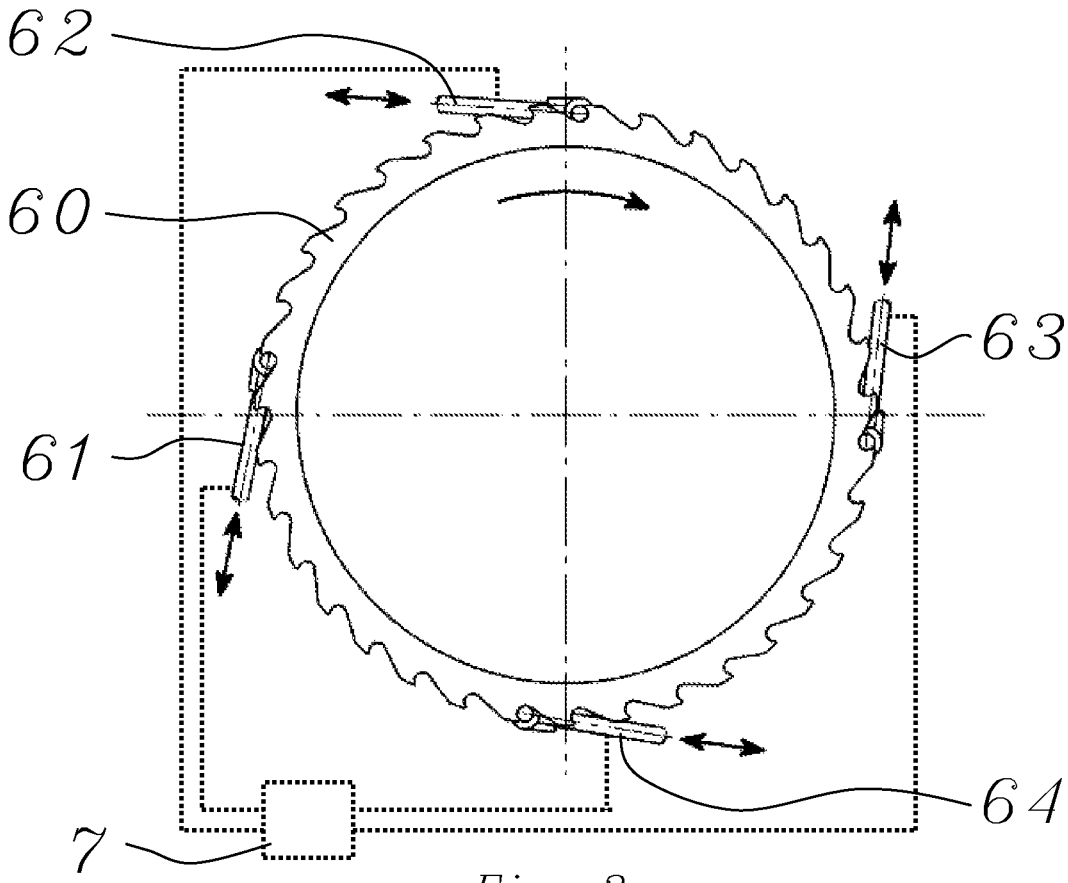
FIG. 2 is a schematic plan view of the auxiliary drive.
Figure 3:
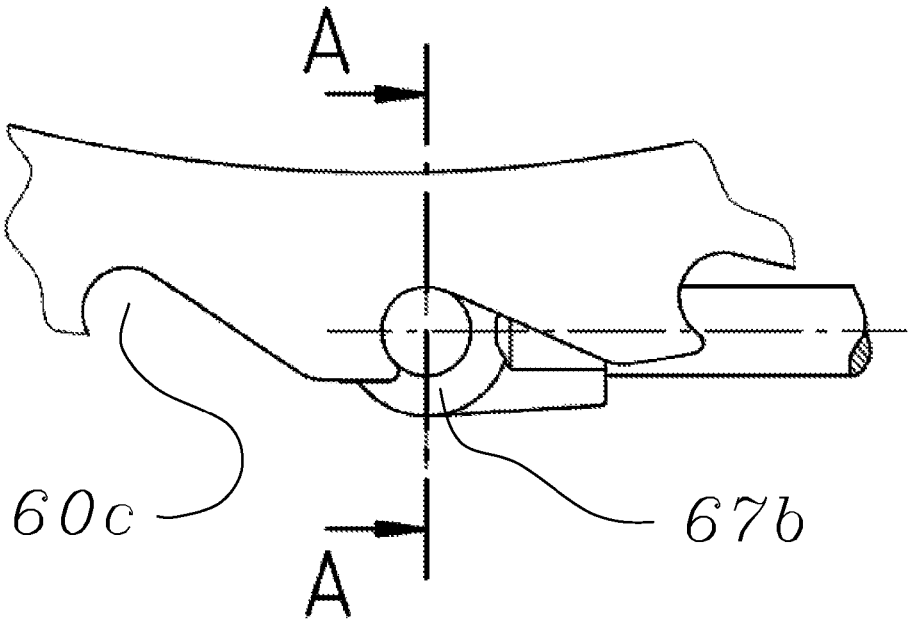
FIG. 3 is a detailed view of the auxiliary drive in the drive position.
Figure 4:
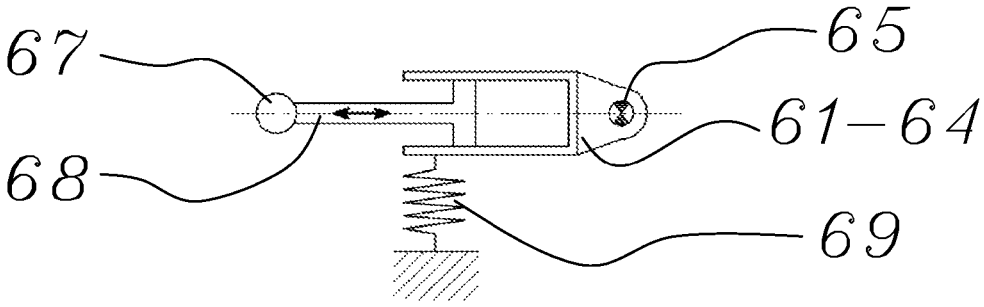
FIG. 4 is a schematic illustration of a pressing system of the auxiliary drive.
Figure 5:
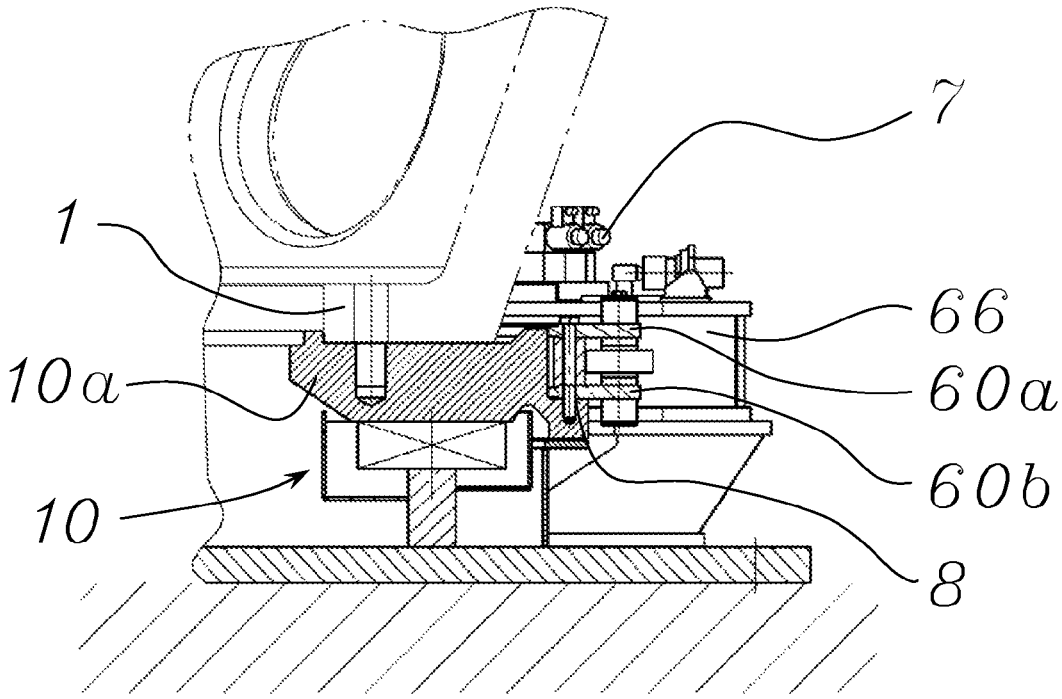
FIG. 5 is a sectioned side view of the roller mill in the region of the auxiliary drive.
Figure 6:
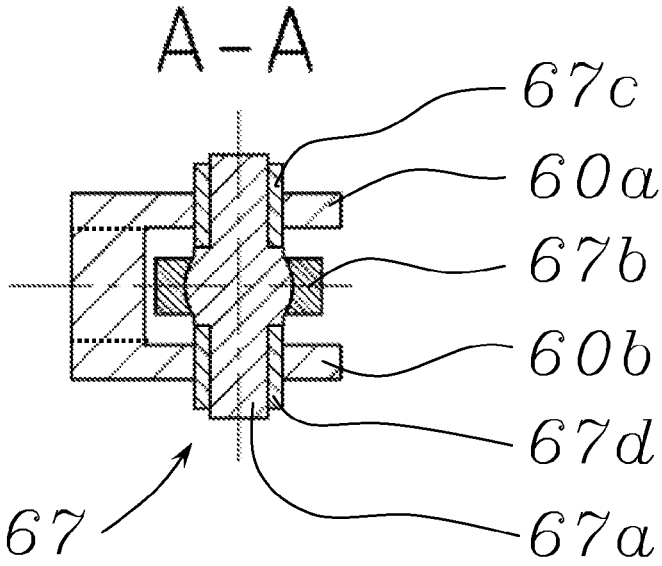
FIG. 6 is a sectioned view along line A-A of FIG. 3.

From FIGS. 2 and 6, it can be seen that the auxiliary drive 6 has a ratchet wheel 60, which is securely connected to the grinding table 1, and four linear drives 61 to 64 which are arranged so as to be distributed in a uniform manner over the periphery of the ratchet wheel 60.

The ratchet wheel 60 comprises two ratchet plates 60*a*, 60*b* which are spaced apart from each other and in which ratchet recesses 60*c* are formed. The fitting of the ratchet wheel 60 to the grinding table 1 preferably takes place via a screw connection 8 on a ball race 10*a* of the grinding table bearing 10. The complete module can thereby be preassembled and delivered to the construction site independently of the grinding table 1.

The linear drives are arranged tangentially relative to the ratchet wheel 60 and are preferably formed by means of four hydraulic cylinders which are distributed in a uniform manner over the periphery. The linear drives are rotatably connected to a console 66 and a grinding table bearing 10 by means of a rotary pin 65 which is secured to the housing.

The linear drives 61 to 64 have pressure pins 67 which engage in ratchet recesses 60*c* in such a manner that the linear extension movement of the linear drives is converted into a rotational movement of the grinding table 1. If a linear drive has reached its end position, its piston rod 68 is retracted into its initial position. The linear drives are pressed via a pressing system 69 in the direction towards the mill axis 11 so that the pressure pin 67 moves along on the outer contour of the ratchet wheel 60 and is always in abutment therewith.

After reaching the initial position, the linear drive begins to extend again so that the pressure pin 67 engages in a new ratchet recess 60*c* and the rotation is continued. A control device 7 evaluates measurement signals from a rotary transmitter and other sensors (not illustrated) which provide information relating to positions and speeds of the grinding table 1 and the linear drives 61 to 64. Consequently, the control device 7 controls the movement paths of the linear drives 61 to 64 and co-ordinates them with each other so that all the linear drives have different extension ranges. Consequently, it is possible to combine the movement paths of the linear drives in such a manner that three of the four linear drives are always extended and rotate the ratchet wheel 60 further, whilst the fourth linear drive is retracted in rapid mode and is introduced into a new ratchet recess 60*c*. If the next linear drive has then reached its end position, it returns to its starting position and the remaining three continue the rotation. This successive interaction of the linear drives 61 to 64 can be carried out continuously so that the rotation of the grinding table is also configured so as to be continuous and uniform.

If the start-up operation of the roller mill is ended, all the linear drives return to their non-driving position. The pressure pins 67 are pressed outwards by the console 66 counter to the pressure of the pressing system 69 and are consequently rotated out of the engagement region of the ratchet wheel 60 (see spacing A between the ratchet wheel and linear drive in FIG. 7). In this non-drive position of the auxiliary drive 6, the ratchet wheel 60 may rotate in a contact-free manner with the grinding table 1, without the pressure pins 67 being pressed onto the ratchet wheel 60 and during normal mill operation constantly bouncing over the ratchets.

For better transmission of force, it is advantageous to allow the pressure pins 67 to engage in the ratchet recesses 60*c* of the two ratchet plates 60*a*, 60*b*. To this end, the pressure pin shaft 67*a* is connected to the piston rod 68 by means of an articulated lug 67*b* so that a uniform load of the ratchet recesses 60*c* of the two ratchet plates 60*a*, 60*b* is adjusted. Owing to sleeves 67*c*, 67*d* on the pressure pin shaft 67*a*, the materials of the contact partners can be adapted to each other. At the same time, this allows easy exchange of the sleeves 67*c*, 67*d* in the event of wear on the pressure pin 67.

The rotation by the auxiliary drive 6 takes place until the drive force of the grinding rollers 2, 3 is reliably transmitted via the grinding stock and they take over the driving of the grinding table. Since the grinding table rotation speeds may differ at this time owing to the auxiliary drive 6 and the main drive systems 4, 5 of the grinding rollers, it is necessary to ensure a smooth transition between both drive types. This is achieved by the ratchet wheel, in a similar manner to an overrunning clutch or a free wheel, being able to overrun freely and the linear drives 61 to 64 being pressed outwards against the pressing system 69.

Figure 7:
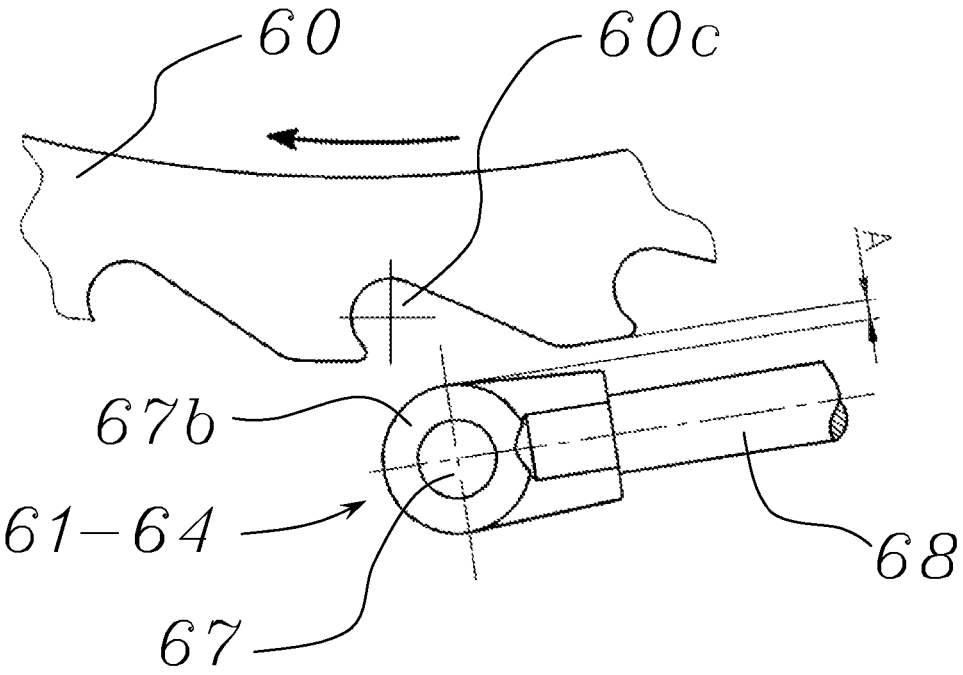
FIG. 7 is a detailed view of the auxiliary drive in the non-drive position.

If reliable milling operation is achieved, the linear drives 61 to 64 are moved into the non-drive position illustrated in FIG. 7 so that the pressure pins 67 are positioned laterally outwards and the ratchet wheel 60 can rotate freely and without contact therewith.

With corresponding construction of the linear drives 61 to 64 and the control device 7, the auxiliary drive 6, in addition to its actual function when the mill is started up, can also be used during maintenance operations. It is thus possible, during mill installation and conversion operations, to position the grinding table 1 in a specific rotation position or, when welding a worn grinding path, to rotate the grinding table slowly and to control this rotation. A separate maintenance drive for the grinding table 1 which is otherwise required can thereby be dispensed with.

Figure 8:
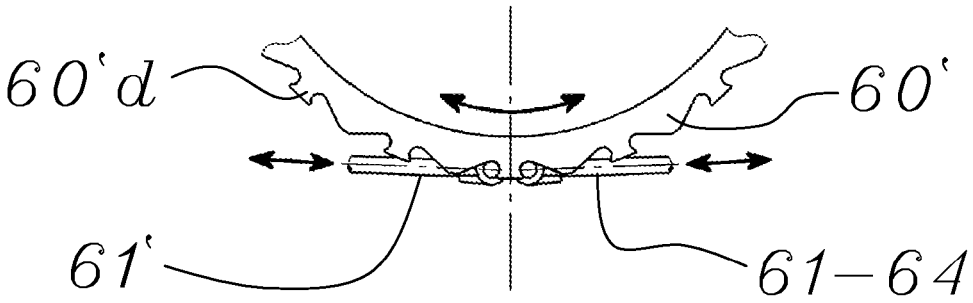
FIG. 8 is a plan view of an auxiliary drive for both rotation directions.

FIG. 8 illustrates a variant of a ratchet wheel 60' with opposing ratchets 60'*d*. If at least one more linear drive 61' is arranged in an opposing direction in addition to the linear drives 61 to 64 described above, the grinding table 1 can be rotated in both rotation directions. In this configuration, however, the above-mentioned overrunning of the ratchet wheel and the guiding of the pressure pins 67 along the edge of the ratchet wheel 60' are no longer possible. Therefore, at least in this variant, an actively controlled radial inward and outward pivoting action of the linear drives is indispensable.

The auxiliary drive 6 described above is consequently capable of carrying out the following function, with an appropriate configuration:

- providing a high grinding table torque for clearing the mill after an emergency stop and with a discharge ring which is filled with material;
- supplying grinding stock to the grinding rollers when the mill is started;
- supporting the main drives of the grinding rollers during the starting operation;
- positioning the grinding table during assembly and maintenance operations and
- speed-variable driving of the grinding table during grinding path welding operations.

The invention claimed is:

1. Roller mill having a grinding table, at least one grinding roller which is in rolling engagement with the grinding table, a main drive system for driving the grinding roller and/or the grinding table and an auxiliary drive for driving the grinding table, characterised in that the auxiliary drive comprises at least two linear drives for rotating the grinding table and a control device for individually controlling the linear drives in order to provide an uninterrupted rotational movement.

2. Roller mill according to claim 1, characterised in that the linear drives are connected to the grinding table by means of at least one coupling gear.

3. Roller mill according to claim 2, characterised in that the coupling gear is formed by a ratchet wheel which is secured to the grinding table.

4. Roller mill according to claim 1, characterised in that the linear drives can be adjusted between a drive position and a non-drive position, the linear drives in the drive position being in operational contact with the grinding table in order to rotate it, whilst the contact with the grinding table is cancelled in the non-drive position.

5. Roller mill according to claim 1, characterised in that the linear drives are arranged at an angle of +/−10° with respect to the grinding table tangent.

6. Roller mill according to claim 1, characterised in that there is provided at least one additional linear drive which is arranged in the opposing direction in order to optionally drive the grinding table in the opposing direction of rotation.

7. A method for driving a roller mill having at least one grinding roller in rolling engagement with a grinding table, the method comprising the steps of:

driving the grinding roller or the grinding table or both by means of a main drive system, rotating the grinding table by means of an auxiliary drive including at least two linear drives, and individually controlling the at least two linear drives to travel forward and backward via a control device such that the rotational movement in said step of rotating the grinding table is uninterrupted.

8. The method according to claim 7, wherein, in said step of individually controlling, the forward and backward travel of the at least two linear drives are carried out at different times.

9. The method according to claim 7, wherein, in said step of individually controlling, at least one of the linear drives is retracted from its outermost end position, whilst at least one other of the linear drives continues to carry out its operating travel.

10. The method according to claim 7, wherein, in said step of individually controlling, the travel speed of the linear drives is adjusted in a variable manner in order to produce different speeds of the grinding table.

* * * * *